US009151259B2

(12) United States Patent
Mosser et al.

(10) Patent No.: US 9,151,259 B2
(45) Date of Patent: Oct. 6, 2015

(54) STEPPED ORIFICE HOLE

(75) Inventors: Mark William Mosser, Williamsburg, VA (US); Michael Gene Pacyga, Hampton, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 598 days.

(21) Appl. No.: 13/493,262

(22) Filed: Jun. 11, 2012

(65) Prior Publication Data

US 2013/0327855 A1 Dec. 12, 2013

(51) Int. Cl.

| | |
|---|---|
| ***F02M 61/00*** | (2006.01) |
| ***F02M 61/18*** | (2006.01) |
| ***B05B 1/02*** | (2006.01) |
| ***B05B 1/14*** | (2006.01) |

(52) U.S. Cl.

CPC ..... *F02M 61/1833* (2013.01); *B05B 1/02* (2013.01); *B05B 1/14* (2013.01); *F02M 61/186* (2013.01); *F02M 61/1806* (2013.01); *F02M 61/1853* (2013.01); *F02M 2200/8069* (2013.01); *Y10T 29/49996* (2015.01); *Y10T 83/0481* (2015.04)

(58) Field of Classification Search

CPC ..... F02M 61/1806; F02M 61/1853; F02M 61/1833; F02M 61/186; B05B 1/02; B05B 1/14

USPC ..... 239/552, 596, 533.12, 601

See application file for complete search history.

(56) References Cited

U.S. PATENT DOCUMENTS 6,826,833 B1 * 12/2004 Maier et al. ..... 239/601
8,016,214 B2 * 9/2011 Higuma et al. ..... 239/533.12

* cited by examiner

*Primary Examiner* — Steven J Ganey

(57) ABSTRACT

An orifice plate used as part of a fuel injector. The orifice plate has a base portion, an offset portion integrally formed with the base portion, a flow entry side and a flow exit side, where the base portion and the offset portion are part of the flow entry side and the flow exit side. A plurality of exit apertures is integrally formed with the offset portion. Each of the plurality of exit apertures includes a plurality of stepped portions, and at least one inner diameter, and each exit aperture is disposed at an angle relative to a central axis extending through the orifice plate. Each exit aperture is of a depth that is about twice the size of the inner diameter, providing optimal atomization of the fluid as the fluid flows through the exit apertures.

11 Claims, 3 Drawing Sheets

STEPPED ORIFICE HOLE

FIELD OF THE INVENTION

The invention relates generally to injectors, and more particularly, an orifice disc for a fuel injector which provides sufficient atomization of fuel.

BACKGROUND OF THE INVENTION

Injectors are a commonly used device for injecting fuel into the cylinders of an internal combustion engine. One of the ways to improve the efficiency of an engine is to inject the fuel in an "atomized" form. Fuel that is atomized burns much more efficiently, allowing as much of the fuel to be used as possible.

Different fuel injectors are often used with different types of fuel, which have different material properties, and react differently to various temperature changes. One such type of fuel is ethanol, which freezes or solidifies during cold weather conditions. Many attempts have been made to improve the operation of a fuel injector used with ethanol to eliminate freezing of the ethanol.

Spray generation, or atomization, is created by the fluid stream breaking into droplets, while being directed in a specific direction. Breakup of the fluid stream is further enhanced by keeping the fluid turbulent as it exits the orifice hole. One of the factors that influence the atomization of the fluid is the shape of the exit orifice or exit aperture through which the fluid passes as the fluid exits the injector. Some injectors include a plate which may have several exit apertures through which the fluid passes. If the fluid flow becomes laminar, or streamlined, to the wall of the exit aperture, the fluid droplets become elongated and create large droplets, or "ligaments." The definition of the size of a ligament is quantified by the particle size measurement of Sauter Mean Diameter (SMD).

One of the contributing factors to this particle size is the ratio of the material thickness or depth of the wall of the exit aperture to the diameter of the wall of the exit aperture, referred to as the L/D ratio. As the depth or thickness of the exit aperture is minimized, atomization is improved. However, using a plate which is of a single thickness and minimizing the thickness of the exit aperture to improve atomization also requires that the material used to create the plate be minimized in thickness as well, which then reduces the weld properties of the plate, increasing the difficulty in welding the plate to the injector during assembly.

When the thickness of the exit aperture is above a certain value, such as 0.006 inches, and the L/D ratio approaches 1.0, the fluid, or fuel in liquid form, reattaches to the wall of the aperture, causing ligaments and larger droplets. The ligaments often build up in the injector, which causes problems during cold starts.

Accordingly, there is a need for a plate having an exit aperture or orifice used in a fuel injector which reduces droplet size, and therefore reduces or eliminates the formation of ligaments and large droplets, where the plate still maintains desirable weld properties.

SUMMARY OF THE INVENTION

The present invention is an orifice plate used as part of a fuel injector. The orifice plate has a base portion, an offset portion integrally formed with the base portion, and a flow entry side, where the base portion and the offset portion are part of the flow entry side. The orifice plate also includes a flow exit side, where the base portion and the offset portion are also part of the flow exit side. The orifice plate also has a recessed surface formed as part of the offset portion such that the recessed surface is located on the flow entry side, and a raised surface formed as part of the offset portion, where the raised surface is located on the flow exit side. An inner side wall is adjacent the recessed surface, and an outer side wall is adjacent the raised surface. A plurality of exit apertures is integrally formed with the offset portion. Each of the plurality of exit apertures includes a plurality of stepped portions, and each exit aperture is of a depth which is twice the size of the inner diameter, to provide optimal atomization of fuel as the fuel passes through each of the exit apertures.

It is an object of the present invention to provide an orifice plate which is made of a single piece of material, or a single plate, with a plurality of exit apertures, where the plurality of exit apertures provide improved atomization of fuel flowing through an injector.

It is another object of this invention to control flow rate through an orifice plate by controlling the flow diameter of the orifice, and coining during the manufacturing process.

It is yet another object of this invention to control the spray pattern through the use of dimple geometry, and to improve breakup of the fuel flow through locally reduced material thickness.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
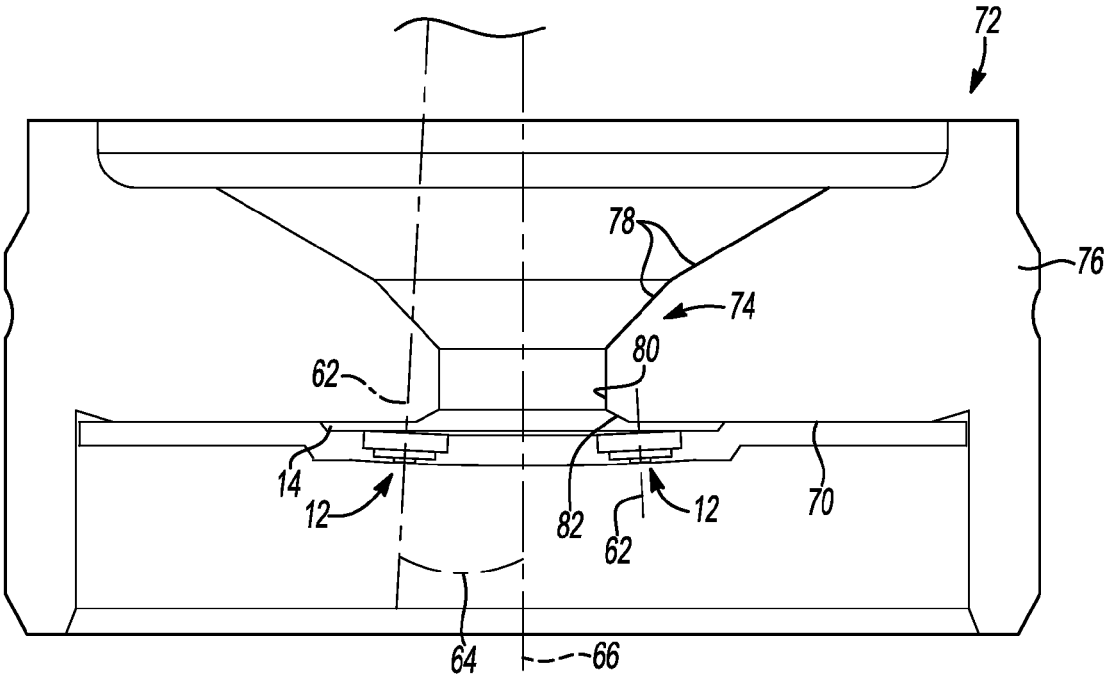
FIG. 1 is a sectional side view of part of a fuel injector having an orifice plate, according to embodiments of the present invention.
Figure 2:
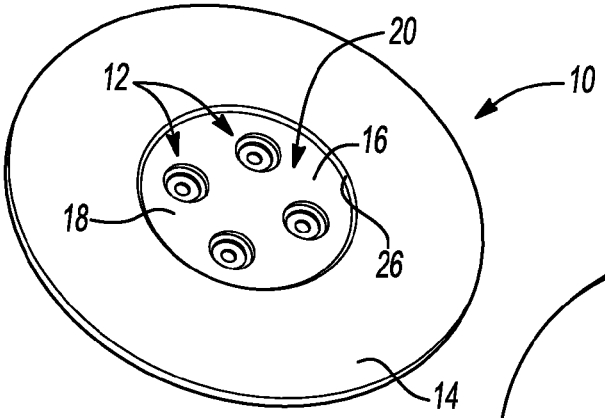
FIG. 2 is a perspective view of the flow entry side of an orifice plate, according to embodiments of the present invention.
Figure 3:
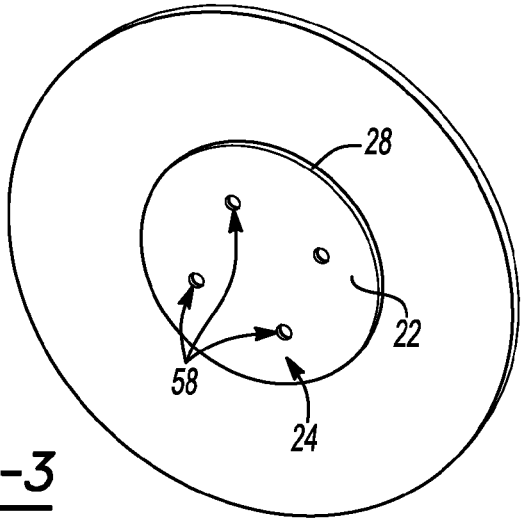
FIG. 3 is a perspective view of the flow exit side of an orifice plate, according to embodiments of the present invention.

The following description of the preferred embodiment(s) is merely exemplary in nature and is in no way intended to limit the invention, its application, or uses.

An orifice plate having a stepped orifice aperture or hole according to embodiments of the present invention is shown in the Figures generally at 10. The plate 10 has at least one, but in some embodiments has a plurality of stepped apertures, shown generally at 12, which allow fluid, such as fuel, to pass through.

The plate 10 is a single piece part, and has base portion 14 and an offset portion 16. The offset portion 16 forms a recessed surface 18 on the flow entry side, shown generally at 20, and also forms a raised surface 22 on the flow exit side, shown generally at 24. Surrounding the recessed surface 18 is an inner side wall 26 which is substantially parallel to an outer side wall 28, and the outer side wall 28 is adjacent to the raised surface 22. The offset portion 16 is curved or at least partially spherical in shape, such that each of the plurality of stepped apertures 12 are at an angle relative to the center of the plate 10.

Each stepped aperture 12 includes at least one stepped portion, and in the embodiments shown in the Figures, a plurality of stepped portions. More specifically, each stepped aperture 12 includes a first stepped portion, shown generally at 30, a second stepped portion, shown generally at 32, and a third stepped portion, shown generally at 34. Each stepped portion 30,32,34 includes various surfaces. The first stepped portion 30 has a first inner diameter (ID) surface 36 and a first step surface 38, the second stepped portion 32 includes a second ID surface 40 and a second step surface 42, and the third stepped portion 34 includes a third ID surface 44.

Each stepped portion 30,32,34 includes an inner diameter, and a depth. The first stepped portion 30 includes a first inner diameter 46, which is about 0.025 inches, and a first depth 48, which is about 0.003 inches. The second stepped portion 32 includes a second inner diameter 50, which is about 0.014 inches, and a second depth 52, which is about 0.0015 inches. The third stepped portion 34 includes a third inner diameter 54 which is about 0.007 inches, and a third depth 56, which is also about 0.0015 inches. The third stepped portion 34 also includes the aperture 58 (which may also be referred to as an exit orifice) through which the fuel flows through. Each of the inner diameters 46,50,54 and the depths 48,52,56 may be changed to allow the orifice plate 10 to be used in different applications.

The third stepped portion 34 having the third inner diameter 54 and the third depth 56 is such that the ratio between the two is as low as possible. However, while the thickness of the third depth 56 is reduced to improve breakup of the jet stream of fuel and increasing atomization, the thickness of the third depth 56 must be thick enough to meet weld robustness requirements. In a preferred embodiment, the third depth 56 is twice the size of the third inner diameter 54. In one embodiment, the third depth 56 is approximately 0.0030 inches; however, it is within the scope of the invention that the third depth 56 may be of other dimensions as well.

Figure 4A:
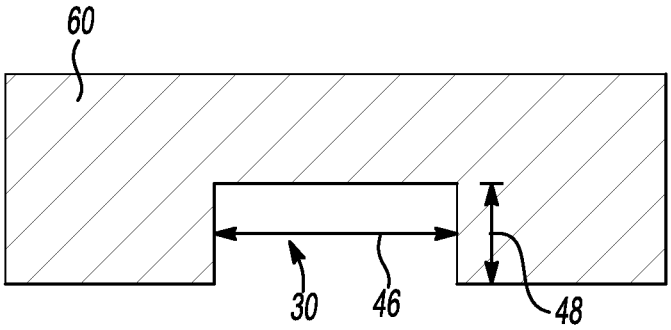
FIG. 4A sectional side view of part of an orifice plate with a first stepped portion punched into the plate, according to embodiments of the present invention.

The orifice plate 10 may be produced in a number of ways. In an embodiment, a series of progressive dies are used to form the plate 10. A flow diagram describing the process used to create the plate 10 is shown in FIG. 7 generally at 100. The orifice plate 10 is initially in the form of a blank or base plate 60, a portion of which is shown in FIGS. 4A-4C, 5 and 6, having an overall thickness of 0.006 inches. In the first step 102, a pilot and orientation hole is used to properly align the blank 60 (only a portion of which is shown in the Figures), and a first die punches a portion of the material and moves a portion of the material in the blank 60, such that the blank 60 appears as shown in FIG. 4A. During this first step 102, the first stepped portion 30 is formed, and as mentioned above, has a depth 48 of about 0.003 inches.

Figure 4B:
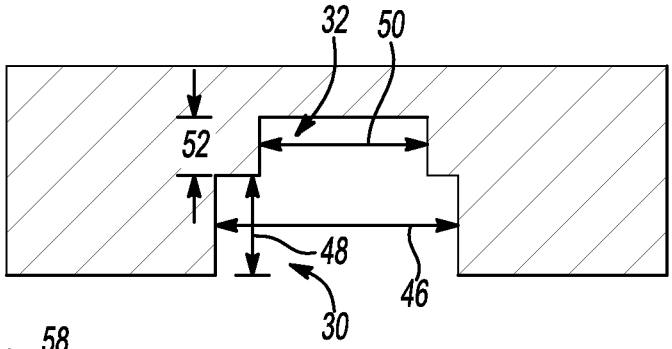
FIG. 4B sectional side view of part of an orifice plate with a first stepped portion and a second stepped portion punched into the plate, according to embodiments of the present invention.
Figure 4C:
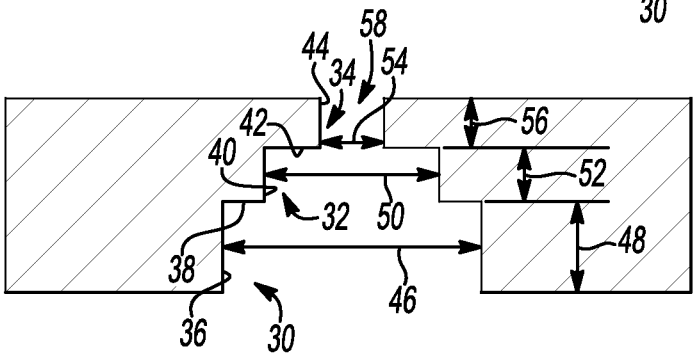
FIG. 4C sectional side view of part of an orifice plate with a first stepped portion, a second stepped portion, and a third stepped portion punched into the plate, according to embodiments of the present invention.

The second step 104 is a flatten operation to prepare the blank 60 for the second punching operation. The third step 106 is to form the second stepped portion 32 using a second punch, as shown in FIG. 4B. As mentioned above, the second depth 52 of the second stepped portion 32 is about 0.0015 inches, but it is within the scope of the invention that other dimensions may be used as well. The fourth step 108 is to perform another flatten operation to prepare the blank 60 for the final punching operation. In the fifth step 110, the third stepped portion 34 is formed, thereby forming the exit aperture 58 as well, best seen in FIG. 4C. The third inner diameter 54 is about 0.007 inches, but it is within the scope of the invention that other diameter sizes may be used as well, depending upon flow requirements, and the type of material used.

The sixth step 112 is to displace a portion of the plate 10 to form the offset portion 16. This is also accomplished by using a punch having at least a rounded portion, or a partially spherical shape. Each aperture 58 includes an axis 62, and the offset portion 16 is curved or at least partially spherical in shape such that each aperture 58 is located at an angle 64 relative to a central axis or vertical axis 66, where the vertical axis 66 extends through the center of the plate 10, best seen in FIG. 1. This angle 64 is generally in the range of zero degrees to fifteen degrees.

Figure 5:
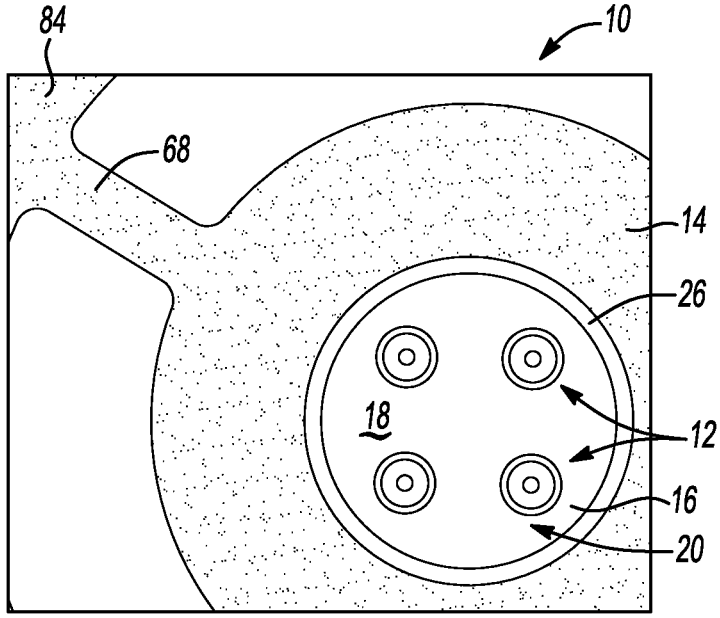
FIG. 5 is a top view of the flow entry side of an orifice plate, prior to the plate being removed from a blank, according to embodiments of the present invention.
Figure 6:
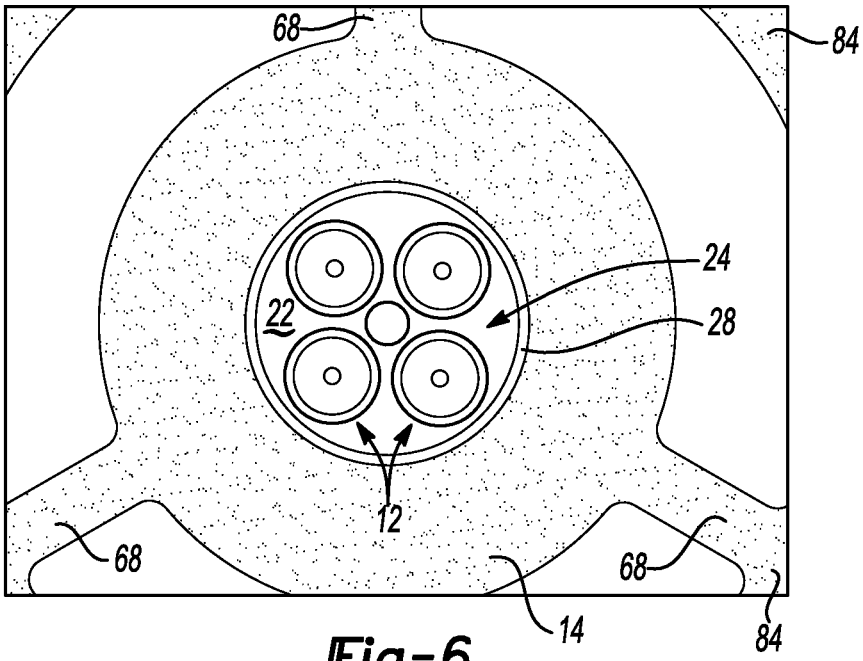
FIG. 6 is a bottom view of the flow exit side of an orifice plate, prior to the plate being removed from a blank, according to embodiments of the present invention.
Figure 7:
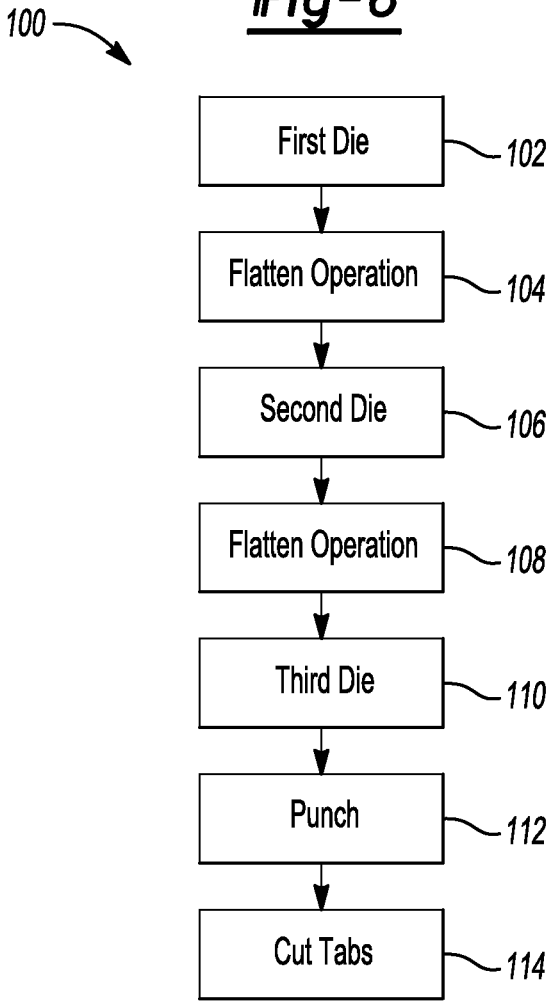
FIG. 7 is a flow diagram of the process used to create an orifice plate, according to embodiments of the present invention.

The seventh step 114 is to cut the tabs 68 from the base portion 14, shown in FIGS. 5-6, thereby removing the tabs 68 and the outer portion 84 from the plate 10, producing the completed plate 10. Prior to this step 114, all of the stepped portions 30,32,34 are formed in the plate 10, as well as the offset portion 16, and the plate appears as shown in FIGS. 5-6 prior to the tabs 68 and outer portion 84 being removed.

Referring again to FIG. 1, once the plate 10 is complete, the plate 10 is welded to a mounting surface 70 which is part of an injector nozzle, shown generally at 72. The injector nozzle 72 includes a nozzle portion, shown generally at 74, and body portion 76. The nozzle portion 74 includes several tapered sections 78 of varying shape to facilitate fluid flow through a nozzle aperture 80. There is also a lower tapered portion 82 below the nozzle aperture 80, as shown in FIG. 1. The base portion 14 of the orifice plate 10 is of sufficient thickness to provide for an adequate welding attachment to the mounting surface 70, without the risk of failure due to a thin cross section of material. The flow rate of fuel is controlled by the size of the third inner diameter 54, and the formation of the stepped portions 30,32,34, and the offset portion 16. The stepped portions 30,32,34 and offset portion 16 may be formed by stamping or coining, or other type of suitable manufacturing processes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

an orifice plate, including:

a flow entry side;

a flow exit side on the opposite side of the orifice plate as the flow entry side;

an axis extending through the center of the orifice plate; and at least one exit aperture having an inner diameter and a depth, the at least one exit aperture extending from the flow entry side to the flow exit side, through which fluid flows;

wherein the at least one exit aperture is disposed at an angle relative to the axis, and the at least one exit aperture is of a depth that is about twice the size of the inner diameter, atomizing the fluid as the fluid flows through the at least one exit aperture the at least one exit aperture further comprising:

a first stepped portion having an inner diameter;

a second stepped portion integrally formed with the first stepped portion, the second stepped portion having an inner diameter which is smaller than the inner diameter of the first stepped portion; and a third stepped portion integrally formed with the second stepped portion, the third stepped portion having and inner diameter which is smaller than the inner diameter of the second stepped portion;

wherein the third inner diameter includes an aperture at the flow exit side, through which fuel flow through, the fuel being atomized by the third stepped portion.

2. The apparatus of claim 1, the at least one exit aperture further comprising a plurality of exit apertures, where in the fuel is atomized as the fuel passes through each of the plurality of exit apertures.

3. The apparatus of claim 1, the first stepped portion further comprising:

a first inner diameter surface forming the first inner diameter; and a first step surface oriented substantially perpendicular to the first inner diameter surface.

4. The apparatus of claim 1, the second stepped portion further comprising:

a second inner diameter surface forming the second inner diameter; and a second step surface oriented substantially perpendicular to the second inner diameter surface.

5. The apparatus of claim 1, the third stepped portion further comprising:

a third inner diameter surface forming the third inner diameter; and a third step surface oriented substantially perpendicular to the third inner diameter surface;

wherein the third inner diameter surface if of a depth that is about twice the size of the third inner diameter, atomizing the fluid as the fluid flows through the aperture.

6. The apparatus of claim 1, further comprising an offset portion, the at least one exit aperture formed as part of the offset portion.

7. The apparatus of claim 6, the offset portion further comprising:

a recessed surface formed as part of the flow entry side;

a raised surface formed as part of the flow exit side on the opposite side of the orifice plate as the recessed surface;

wherein the offset portion is of a curved shape such that the at least one exit aperture is at an angle relative to the axis extending through the center of the orifice plate.

8. An orifice plate used as part of a fuel injector, comprising:

a base portion;

an offset portion integrally formed with the base portion;

a flow entry side, the base portion and the offset portion being part of the flow entry side;

a flow exit side, the base portion and the offset portion being part of the flow exit side;

a recessed surface formed as part of the offset portion, the recessed surface located on the flow entry side;

a raised surface formed as part of the offset portion, the raised surface located on the flow exit side;

an inner side wall adjacent the recessed surface;

an outer side wall adjacent the raised surface; and a plurality of exit apertures integrally formed with the offset portion, each of the plurality of exit apertures having a plurality of stepped portions;

wherein each of the plurality of exit apertures is of a depth which is less than the diameter, atomizing fuel as the fuel passes through each of the plurality of exit apertures, each of the plurality of exit apertures further comprising:

a first stepped portion having an inner diameter; pg,16 a second stepped portion integrally formed with the first stepped portion, the second stepped portion having an inner diameter which is smaller than the inner diameter of the first stepped portion; and a third stepped portion integrally formed with the second stepped portion, the third stepped portion having an inner diameter which is smaller than the inner diameter of the second stepped portion, wherein the inner diameter of the third stepped portion includes and aperture at the flow exit side, through which fuel flow through, the fuel being atomized by the third stepped portion.

9. The orifice plate of claim 8, the first stepped portion further comprising:

a first inner diameter surface having a first inner diameter and a first depth; and a first step surface adjacent the first inner diameter surface.

10. The orifice plate of claim 9, the second stepped portion further comprising:

a second inner diameter surface adjacent the first step surface; and a second step surface adjacent the second inner diameter surface;

wherein the second inner diameter surface has a second inner diameter and a second depth.

11. The orifice plate of claim 10, the third stepped portion further comprising:

a third inner diameter surface adjacent the second step surface; and a third step surface adjacent the third inner diameter surface;

wherein the third inner diameter surface has a third inner diameter and a third depth, and the third depth is about twice the size of the third inner diameter.

* * * * *